US005217503A

United States Patent [19]

Leehe et al.

[11] Patent Number: 5,217,503

[45] Date of Patent: Jun. 8, 1993

[54] PROCESS FOR DESULFURIZATION OF COAL AND ORES

[75] Inventors: Henry H. Leehe, Plainville, Ind.; Glenn A. Atwood, Akron, Ohio

[73] Assignee: Midwest Ore Processing Company, Inc., Plainville, Ind.

[21] Appl. No.: 670,892

[22] Filed: Mar. 18, 1991

[51] Int. Cl.[5] ..... C10L 9/00; C10L 9/06; C10L 9/02

[52] U.S. Cl. ..... 44/620; 44/622

[58] Field of Search ..... 44/622, 623, 620

[56] References Cited

U.S. PATENT DOCUMENTS

| | | | |
|---|---|---|---|
| Re. 32,454 | 7/1987 | Starbuck | 44/622 |
| 4,448,584 | 5/1984 | Masologites | 44/623 |
| 4,528,069 | 7/1985 | DuBroff | 44/621 |
| 4,655,896 | 4/1987 | Yoon | 44/623 |
| 4,725,337 | 2/1988 | Greene | 44/622 |

*Primary Examiner*—Jerry Johnson
*Attorney, Agent, or Firm*—Fisher, Christen & Sabol

[57] ABSTRACT

An additional step directed to the Starbuck process of desulfurizing coal and ores, as described and claimed in reissue patent No. RE. 32,454 dated Jul. 7, 1987, including the treatment of non-weathered coal ore to simulate weathered coal ore. Several approaches are presented which result in increased sulfur removal and increased pyrite removal.

4 Claims, No Drawings

PROCESS FOR DESULFURIZATION OF COAL AND ORES

BACKGROUND OF THE INVENTION

As is known, a significant contribution directed to the desulfurization of coal and ores is described and claimed in the Arthur E. Starbuck U.S. Re. Pat. No. 32,454, data Jul. 7, 1987, and entitled PROCESS FOR DESULFURIZATION OF COALS AND ORES, owned of record, by means assignment, by Midwest Ore Processing Company, Inc., the same assignee as the invention presented herein. The teachings of the aforesaid patent are incorporated by reference herein.

Importance of the aforesaid Starbuck process lies in the usage of the solvent perchloroethylene to form a liquor in which sulfur dissolves in the solution. The patentee states that the desulfurization process is effective to the extent that less than 0.01 percent free sulfur remains in the coal product after drying. The invention involves pretreatment of the coal under process for even greater organic sulfur removal than achievable heretofore.

HISTORY OF THE PROCESS

Briefly, the desulfurization process of the aforesaid Starbuck patent is a continuous process for desulfurizing ores, such as coal, to recover high grade sulfur and to extract solids which may be further refined. In a typical invention embodiment, the process initially crushes the sulfur bearing coal ore which, thereafter, is mixed with perchloroethylene in which the sulfur dissolves in solution. A centrifuge separates the sulfur and the perchloroethylene of the resulting coal slurry, where another centrifuge separates lightweight coal particles from heavier earth tailings or other sedimentary-type residues.

The sulfur liquor, contaminated with microparticle ash suspension, is filtered to remove the ash from the sulfur and the remaining solution is crystallized by cooling and centrifugally separated from the solvent. The resulting sulfur is dried, where such, being then in solid form, is suitable for marketing. As stated, less than 0.01 percent free sulfur is in the final coal product after drying.

THE IMPROVEMENT OF THE INVENTION

The invention serves two-fold principal purposes, to-wit, to increase organic sulfur removal from non-weathered raw coal and to improve pyrite removal, both being accomplished through the pretreatment of the coal introduced into the process of the Starbuck invention.

The preceding is accomplished by entering steam and air, at steam-to-air ratios from 0.5 to 10.0, subjecting the coal to ambient or elevated pressure from one to five atmospheres, elevated temperatures from 50° C. to 110° C., and holding times from five minutes to four hours.

The foregoing is achieved, in a batch process, by passing the steam air mixture over a bed of coal. In a continuous process, the steam air mixture contacts the coal in devices designed for intimate gas-solid contact, such as falling bed reactors, fluidized beds, rotating drum contactors, and continuous driers. The result is improved organic sulfur and pyrite material values from raw non-weathered coal.

Similar effects are obtained by adding Group 8 transition metal ions, such as iron, nickel or cobalt, before or during the grinding operation included as part of the desulfurization process. Such treatment also significantly improves the amount organic sulfur removed when the coal is processed under the teachings of the Starbuck patent.

A further method of increased organic sulfur removal is by adding hot perchloroethylene extract produced from weathered coal to the hot perchloroethylene which is being used as a means for extracting organic sulfur from virgin or non-weathered coal, being another significant treatment.

As a result of any of the afore-described approaches, 5 to 35 per cent., in a relative scale (in contrast to an absolute scale), additional organic sulfur removal results from non-weathered coals, i.e. through the simulated "weathering" procedures. In other words, simulated weathering is accomplished by subjecting non-weathered coal to weathering treatment with a resulting increase of sulfur removal over coal that has not been weathered. The instant improvement is generally attributed to the formation of ferric or ferrous ions as the iron pyrite reacts during the weathering process.

As should be evident from the preceding, the instant invention is of further importance to the patented Starbuck process of desulfurizing coal and ores, where, through a variety of approaches, both increased sulphur removal is achieved as well as improved pyrite removal. Thus, the overall significance of the presented treatments cannot be overemphasized in satisfying a continual goal. The preceding should be considered illustrative, as described, and not as limiting the scope of the following claims:

We claim:

1. In a process for desulfurizing non-weathered sulfur-bearing raw coal by contacting it with perchloroethylene to dissolve the sulfur in said non-weathered raw coal, the improvement providing even greater organic sulfur removal comprising the step of subjecting said non-weathered raw coal to an elevated temperature of about 122° F. to about 230° F. at ambient to elevated pressure and contacting said raw coal with steam and air while under said conditions of temperature and pressure for a period of time ranging from ten minutes to two hours before contacting said coal with said perchloroethylene.

2. The desulfurizing process of claim 1 where said stem and air is at steam-to-air ratios in a range of 0.5 to 10.0.

3. The desulfurizing process of claim 1 where said pressure is in a range of one to five atmosphere.

4. The desulfurizing process. of claim 1 where said period is in a range of fifteen to forty-five minutes.

* * * * *